US009676531B2

(12) United States Patent
Johansson et al.

(10) Patent No.: US 9,676,531 B2
(45) Date of Patent: Jun. 13, 2017

(54) MEMBRANE, AND A NECK INCLUDING SUCH MEMBRANE

(71) Applicant: TETRA LAVAL HOLDINGS & FINANCE S.A., Pully (CH)

(72) Inventors: Göran Johansson, Stehag (SE); Lennart Stillerud, Lund (SE); Bengt Håkansson, Sjöbo (SE); Pär Rydberg, Genarp (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 14/359,009

(22) PCT Filed: Nov. 16, 2012

(86) PCT No.: PCT/EP2012/072868
§ 371 (c)(1),
(2) Date: May 16, 2014

(87) PCT Pub. No.: WO2013/072475
PCT Pub. Date: May 23, 2013

(65) Prior Publication Data

US 2014/0319142 A1 Oct. 30, 2014

(30) Foreign Application Priority Data

Nov. 18, 2011 (SE) ..... 1151098

(51) Int. Cl.
*B65D 53/04* (2006.01)
*B65D 41/04* (2006.01)
(Continued)

(52) U.S. Cl.
CPC ..... *B65D 53/04* (2013.01); *B65D 41/045* (2013.01); *B65D 41/205* (2013.01);
(Continued)

(58) Field of Classification Search
CPC .... B65D 41/0435; B65D 53/04; B65D 41/04; B65D 51/243; B65D 2543/00037;
(Continued)

(56) References Cited

U.S. PATENT DOCUMENTS 3,331,523 A * 7/1967 Exton ..... 215/350
3,974,928 A * 8/1976 Domaracki et al. ..... 215/211
(Continued)

FOREIGN PATENT DOCUMENTS

FR 1 025 273 A 4/1953
FR 1 197 452 A 12/1959
(Continued)

OTHER PUBLICATIONS

International Search Report (PCT/ISA/210) mailed on Mar. 28, 2013, by the European Patent Office as the International Searching Authority for International Application No. PCT/EP2012/072868.
(Continued)

*Primary Examiner* — J. Gregory Pickett
*Assistant Examiner* — Niki M Eloshway
(74) *Attorney, Agent, or Firm* — Buchanan Ingersoll & Rooney PC

(57) ABSTRACT

A membrane for sealing an open spout of a food package comprises a central circular disc member, an outer annular disc member connected to the central circular disc member along its inner periphery at a connection angle, and a resilient tubular portion extending between a first open end and a second end being connected to the outer annular disc member, the diameter of the second end being smaller than the outer diameter of the annular disc member, wherein the annular disc member is pivotable relative the central circular disc member for increasing the diameter of the second end of the tubular portion by changing the connection angle.

20 Claims, 5 Drawing Sheets

(51) Int. Cl.
*B65D 41/20* (2006.01)
*B65D 51/22* (2006.01)
*B65D 41/34* (2006.01)

(52) U.S. Cl.
CPC .... *B65D 51/228* (2013.01); *B65D 2251/0015* (2013.01); *B65D 2251/0096* (2013.01)

(58) Field of Classification Search
CPC ..... B65D 41/205; B65D 51/228; B65D 2251/0015; B65D 2251/0096; B65D 41/045
USPC ..... 220/284, 213, 285, 304; 215/342, 350, 215/303
See application file for complete search history.

(56) References Cited

U.S. PATENT DOCUMENTS

| | | | | | |
|---|---|---|---|---|---|
| 4,128,184 | A | * | 12/1978 | Northup | 215/222 |
| 4,181,232 | A | | 1/1980 | Bellamy et al. | |
| 4,261,475 | A | * | 4/1981 | Babiol | 215/341 |
| 4,405,054 | A | | 9/1983 | Braun et al. | |
| 4,673,096 | A | * | 6/1987 | Towns et al. | 215/230 |
| 4,685,580 | A | * | 8/1987 | Towns et al. | 215/260 |
| 4,781,483 | A | * | 11/1988 | Lorscheidt | 401/55 |
| 5,012,970 | A | * | 5/1991 | Kucherer | 229/4.5 |
| 5,433,331 | A | * | 7/1995 | Morini | 215/271 |
| 6,095,357 | A | * | 8/2000 | Heiner et al. | 215/270 |
| 6,761,275 | B1 | | 7/2004 | McBride et al. | |
| 8,381,924 | B2 | * | 2/2013 | Parrinello | B26F 1/18 215/349 |
| 2006/0231519 | A1 | * | 10/2006 | Py et al. | 215/342 |
| 2007/0187353 | A1 | * | 8/2007 | Fox et al. | 215/354 |
| 2009/0184082 | A1 | | 7/2009 | Antier et al. | |
| 2010/0258563 | A1 | | 10/2010 | Parrinello et al. | |

FOREIGN PATENT DOCUMENTS

| | | | |
|---|---|---|---|
| FR | 1 279 992 | A | 12/1961 |
| FR | 2900129 | A1 | 10/2007 |
| JP | 57-45469 | U | 3/1982 |
| JP | 2000-103458 | A | 4/2000 |
| JP | 2010-132298 | A | 6/2010 |
| JP | 2010-528946 | A | 8/2010 |
| WO | WO 96/40568 | A1 | 12/1996 |

OTHER PUBLICATIONS

Extended European Search Report issued on Jul. 2, 2015, by the European Patent Office in corresponding European Patent Application No. 15153057.3-1707 (5 pages).

* cited by examiner

MEMBRANE, AND A NECK INCLUDING SUCH MEMBRANE

TECHNICAL FIELD

The present invention generally relates to the field of packaging technology. More particularly, the present invention relates to a membrane for a neck of a food package as well as to a neck including such membrane.

BACKGROUND

Food packages are generally provided with an opening device in order to facilitate discharging of the enclosed food product. The opening device may either be an irreversible opening, i.e. once the package is opened it may not be closed, or a recloseable opening device. In order to extend the shelf-life and quality of the food product the latter is often desired. A common way of providing a recloseable opening device is to arrange a threaded neck including a pouring spout on the upper part of the package. The threaded neck is designed such that it may receive a cap, including internal threads, such that the cap is capable of being unscrewed from the neck. Since the cap covers the open spout of the neck, the enclosed food product is protected from the outer environment and the quality of the product may thus be preserved during some time.

Although the above solution provides an improvement over the irreversible openings which always remain open, it is still possible for polluted media to enter the interior of the package via the neckcap interface, e.g. via the threads. Hence, further improvements have been proposed for sealing the open spout of the neck when the package is stored.

WO9640568 describes a cap and neck assembly, wherein a flexible sheet is connected to the interior of the cap such that is covers the open spout when the cap is screwed tightly onto the neck.

As food package necks are often molded as plastic pieces, molding joints are always present on the exterior surfaces of the neck. This reduces the efficiency of the described sheet since it will be difficult to provide adequate sealing over such non-uniform joints. Further, tolerances of the neck and cap will also affect the quality of the sealing.

U.S. Pat. No. 4,405,054 describes a separate member which is arranged between the cap and the neck for providing additional sealing of the open spout of the neck. Such solution is not very user friendly, since an additional and separate member must be used in order to achieve the desired sealing.

In view of the prior art solutions, there is a need for a membrane which provides required sealing of an open spout of a neck for preserving the quality of a food product enclosed within a food package, as well as pro-longing the shelf life of the food product.

SUMMARY

It is, therefore, an object of the present invention to overcome or alleviate the above described problems.

The basic idea is to provide a membrane which covers an open spout of a neck of a food package, and wherein sealing of the spout is achieved on the interior side of the neck.

A further idea is to provide a membrane which is molded as one piece together with the neck.

A yet further idea is to provide a membrane which may be cut off when the food package is opened for the first time, and retained within the cap for later resealing of the spout of the neck.

According to a first aspect, a membrane for sealing an open spout of a food package is provided. The membrane comprises a central circular disc member, an outer annular disc member connected to said central circular disc member along its inner periphery at a connection angle relative the plane of the central circular disc member, and a resilient tubular portion extending between a first open end and a second end being connected to the outer annular disc member, the diameter of said second end being smaller than the outer diameter of said annular disc member, wherein the annular disc member is pivotable relative the central circular disc member for increasing the diameter of the second end of said tubular portion by changing said connection angle.

According to a second aspect, a neck for a food package is provided. The neck comprises a tubular wall extending from an open end to an open spout along a longitudinal axis, and a membrane according to the first aspect and arranged such that the plane of the central circular disc member is perpendicular to said longitudinal axis, wherein the outer annular disc member of said membrane is connected to said spout for sealing the open spout.

According to a third aspect, a cap arranged to interact with a neck according to the second aspect for forming a capneck assembly of a food package is provided. The cap comprises a tubular side wall section extending between an open lower end to a closed upper end, and at least one resilient cutting element provided on the interior side of said tubular side wall section and configured to cut off a membrane of said neck when said cap is unscrewed from said neck.

According to a fourth aspect, a food package comprising a neck according to the second aspect and a cap according to the third aspect is provided.

According to a fifth aspect, a method is provided for applying a cap according to the third aspect onto a neck according to the second aspect, comprising the step of applying said cap onto said neck such that the at least one resilient cutting element is pulled over said membrane projection.

BRIEF DESCRIPTION OF DRAWINGS

The above, as well as additional objects, features, and advantages of the present invention, will be better understood through the following illustrative and non-limiting detailed description of preferred embodiments of the present invention, with reference to the appended drawings, wherein.

DETAILED DESCRIPTION

Figure 1:
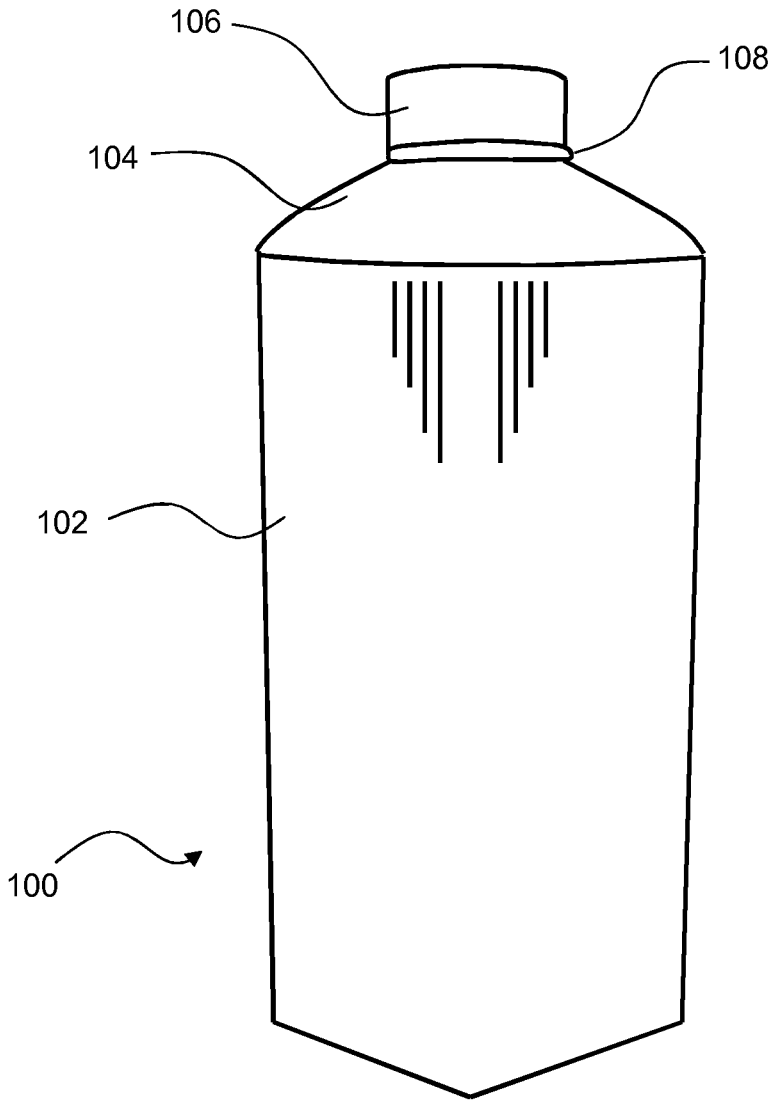
FIG. 1 illustrates a carton-based bottle having a top section made of plastic and a body made of a carton-based laminate.

With reference to FIG. 1, an example of a food package 100 is shown. The food package 100 has a shape of a bottle formed by a body portion 102, which may be made of a carton-based laminate, a top portion 104, which may be made of plastic, and a cap 106 provided with a tamper ring 108.

Such kind of package may be provided by first forming a sleeve of the carton-based laminate, i.e. a tubular body extending between two open ends. In a second step, performed before, after, or in parallel with the sleeve forming, the plastic top portion 104 is provided by molding. The plastic top portion 104 may comprise a shoulder section and a neck portion. The shoulder section is thus arranged to connect the sleeve, which forms basis for the body portion 102, to the neck portion. The neck portion is preferably provided with threads for engaging with corresponding threads of the cap 106 including the tamper ring 108. The neck portion and the shoulder section may be provided as one piece, or as two separate pieces which are molded together.

After the cap is screwed onto the top portion 104 sleeve is filled with food content. Preferably, this is done by turning the sleeve and the top portion assembly upside down, such that the remaining open end of the sleeve is facing upwards. After being filled the open end of the sleeve may be sealed and folded to a flat bottom such that a package according to FIG. 1 is formed. In other embodiments the cap is screwed onto the top portion after the package is filled. This may be the case if the neck is provided with a membrane sealing the open end of the neck portion, which will be described in more details below.

Figure 2:
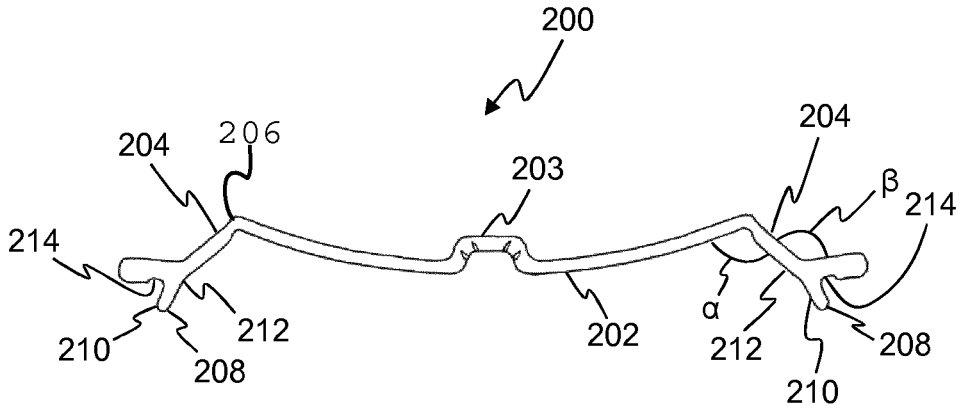
FIG. 2 is a side view of a membrane according to an embodiment.

In FIG. 2, a membrane for sealing an open spout of a neck of a package. The package may preferably be a food package in accordance with the description above, however any kind of package may benefit from the particular membrane.

The membrane 200 has a central circular disc member 202 and an outer annular disc member 204 connected to said central circular disc member 202 along its inner periphery 206. Hence, the inner periphery of the outer annular disc member 204 is connected to the periphery of the central circular disc member 202. The outer annular disc member 204 extends from the central circular disc member 202 at a connection angle $\alpha$ relative the plane of the central circular disc member. Preferably, the connection angle is between 90-180° and even more preferably between 120 and 150°.

The central circular disc member 202 has a concave shape, and may also include a centrally aligned raised portion 203. The concave shape extends away from a cap when such a cap is arranged over the membrane. The concave shape forms a dome which may enable the motion of the membrane in a resealing operation.

The outer annular disc member 204 is preferably formed by two portions connected to each other by an angle $\beta$, preferably in the range of 90-180°, and more preferably in the range of 120-160°. Further, the outer annular disc member 204 is on its lower side, i.e. the side eventually facing the enclosed product, connected to a resilient tubular portion 208 extending between a first open end 210 and a second end 212. The diameter of the second end 212 is smaller than the outer diameter of said annular disc member 204, such that the resilient tubular portion 208 is connected to the outer annular disc portion 204 somewhere between the inner and outer periphery.

Further, the annular disc member 204 is able to pivot relative the central circular disc member 202 for increasing the diameter of the second end 212 of said tubular portion 208 by changing the connection angle $\alpha$ to an increased value.

The ability of the annular disc member 204 to pivot is provided by means of a connecting interface between the central circular disc member 202 and the outer annular disc member 204, formed at the periphery of the central circular disc member 202. The connecting interface has a thickness which is less than the thicknesses of the central circular disc member 202 and the outer annular disc member 204. In other words, the pivoting is achieved due to a reduced material thickness.

Preferably, the tubular portion 208 and the outer annular disc member 204 are formed integrally with the central circular disc member 202 as a plastic component. Preferably, the entire membrane is made of high density polyethylene.

The tubular portion 208 has a tapered wall profile such that the open end 210 has a diameter being larger than the diameter of the second end 212 being closed by the circular disc member 202.

The outer annular disc member 204 further comprises a circular recess 214 arranged exterior of where the second end 212 of the tubular portion 208 is connected to the outer annular disc member 204.

Figure 3:
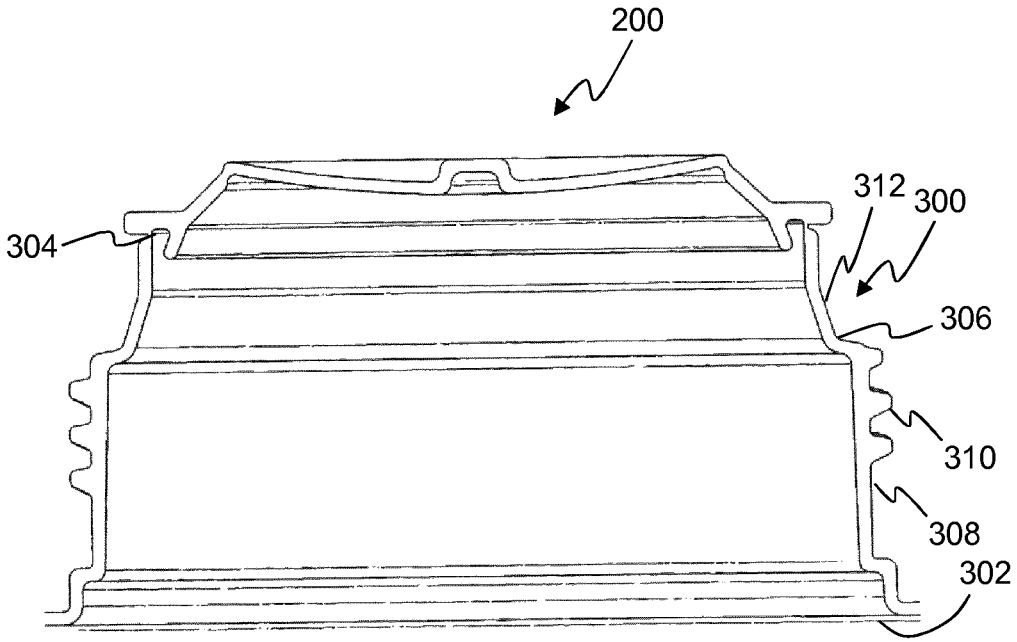
FIG. 3 is a cross sectional view of a neck of a package including the membrane shown in FIG. 2.

The membrane 200 is preferably connected to a neck 300 of a package, which is further shown in FIG. 3. The membrane 200 and the neck 300 are preferably molded as one piece in plastic material, such as HDPE (high density polyethylene). The neck 300, extending from a lower end 302 which is designed to be attached to a sleeve of a package to an upper spout 304, is sealed at the spout 304 by means of the membrane 200. Hence, the membrane 200 is connected by its outer annular disc portion 204 to the spout 304.

The connection is preferably located just exterior of the recess 214.

The neck 300 includes a tubular wall 306 which has a first portion 308 including exterior threads 310 to be engaged with corresponding internal threads of a cap, and a second portion 312 that extends upwards from the first portion 308 and ends with the spout 304. The diameter of the second portion 312 is less than the diameter of the first portion 308 in order to allow the cap to be screwed on. Typically, the diameter of the second portion is less than 50 mm in order to fit on a food package enclosing liquid food at a volume of 0,1 to 2 liters.

Figure 4:
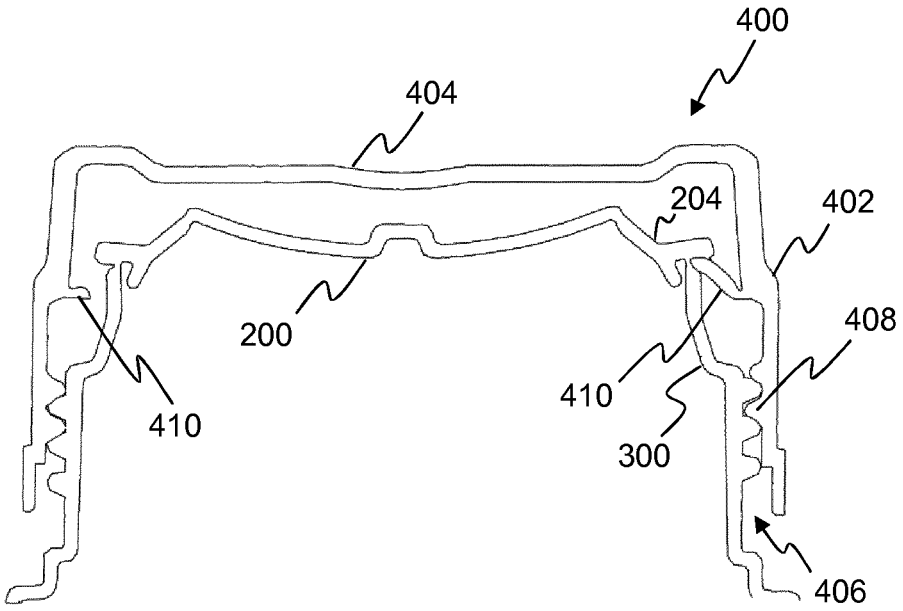
FIG. 4 is a side view of a cap and the neck of FIG. 3 in a pre-sealed condition.

Now turning to FIG. 4, the neck 300 and the membrane 200 are shown as well as a cap 400. The cap 400 comprises a cylindrical wall 402, a closed upper end 404, and an open end 406 through which the neck 300 is inserted. Further, internal threads 408 are provided on the interior surface of the cap 400 for engagement with the threads of the neck 300.

The cap 400 further includes resilient cutting elements 410 arranged on the interior cylindrical wall 402 at a position slightly below the position where the membrane 200 is connected to the neck 300.

Preferably, three resilient cutting elements 410 are arranged at equal peripheral distance from each other, and extend from a first peripheral position to a second peripheral position, wherein the length, as measured in a radial direction of the cap 400, of each resilient cutting element is continuously increasing.

Each cutting element 410 is allowed to pivot at its joint to the cap 400, such that it may be folded upwards to engage with the area where the membrane 200 is connected to the neck 300. This is indicated by the right cutting element 410 in FIG. 4, whereby the left cutting element 410 is showing the first peripheral position of the cutting element 410.

As can be understood by FIG. 4, the cutting elements 410 will bend downwards when the cap 400 is unscrewed from the neck, whereby the cutting elements 410 will be urged inwards and thus cut off the membrane 200 from the neck 300.

Preferably, the cutting elements 410 are subject to an idle position in which they protrude over a part of the annular disc member 204 of the membrane 200, more specifically a free end of the cutting elements extend passed a circumferential edge of the annular disc member 204 of the membrane. 200. Hence, the cutting elements 410 will retain the membrane 200 within the cap 400 after the cap 400 has been completely unscrewed from the neck 300.

Figure 5A:
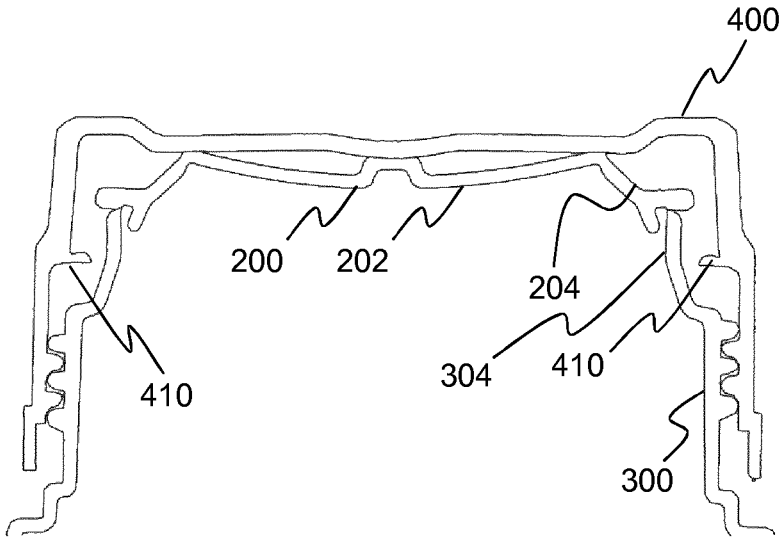
FIG. 5*a-c* show a resealing sequence of the cap and neck assembly.
Figure 5B:
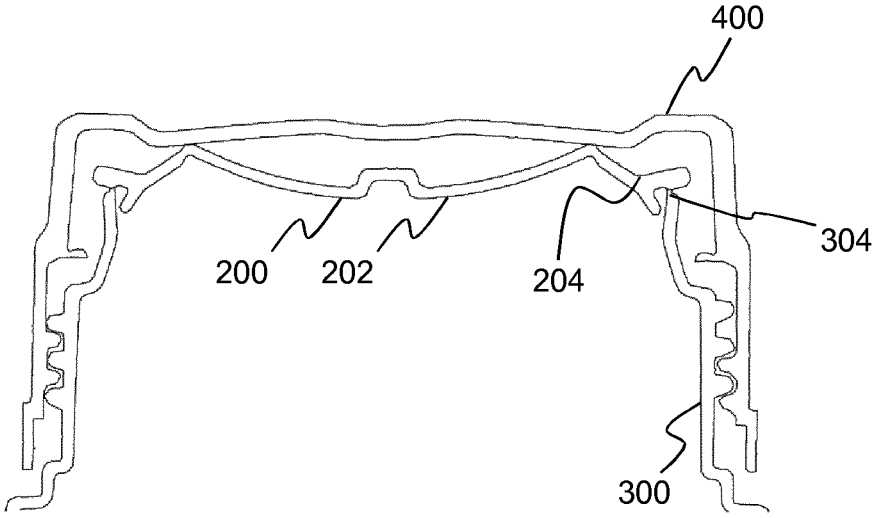
Figure 5C:
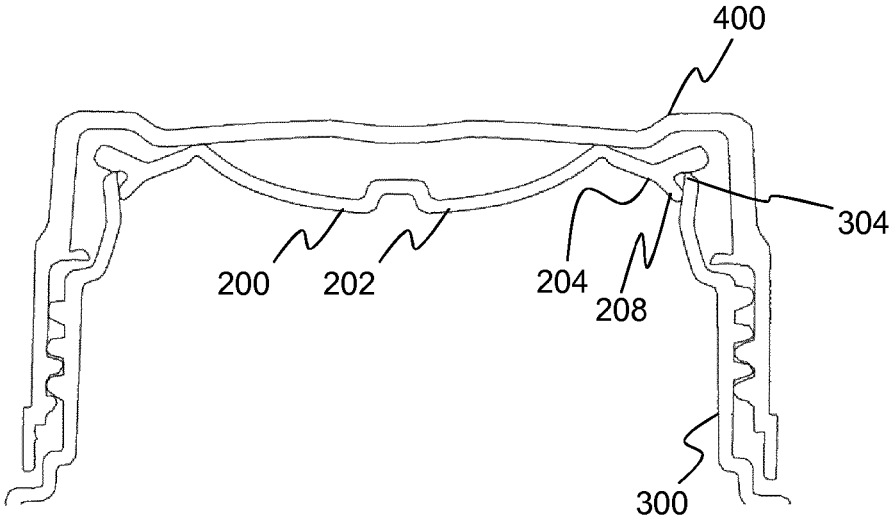

Now turning to FIGS. 5*a* to *c*, a closing sequence of a cap and neck assembly is shown. Prior to such sequence, it is assumed that the cap 400 has once been unscrewed from the neck 300 such that the membrane 200 has been separated from the neck 300.

Starting with FIG. 5*a*, the cap 400 has been screwed on the neck 300. As the cutting elements 410 are retaining the membrane 200 initially, the cutting elements 410 will however be disengaged from the membrane 200 when the membrane 200 is reaching the spout 304 of the neck 300. Hence, as is shown in FIG. 5*a*, the membrane 200 will rest on the spout 304 while the cap moves down the neck due to the provision of the threads, converting a rotational movement to a vertical movement.

In FIG. 5*a*, the membrane 200 is on its upper side in contact with the closed end of the cap 400, while it rests on the spout 304 of the neck 300 on its lower side.

When the cap 400 is screwed further downwards, as is shown in FIG. 5*b*, the closed end of the cap 400 will interact with the joint connecting the inner circular disc member 202 with the outer annular disc member 204. Hence, the connection angle $\alpha$ will increase and the outer diameter of the annular disc member 204 will consequently also increase and move towards the interior side of the spout 304.

This procedure is continued as the cap 400 is further rotated down the neck 300. In FIG. 5*c* the cap 400 is tightly screwed onto the neck 300, and the connection angle $\alpha$ has consequently been subject to a further increase. Hence, the tubular wall portion 208 is urged radially outwards until it contacts the interior wall of the spout 304 of the neck 300. At the same time, the upper end of the spout 304 engages with the circular recess 214 such that the membrane 200 locks in the desired sealing position. The membrane 200 thus seals the spout 304 of the neck such that the outer environment is unable to affect the food product enclosed within a package equipped with the neck 300, the membrane 200, and the cap 400.

The membrane 200 as been described throughout the description provides a sealing of the spout of the neck in a very efficient manner. As the sealing is provided on the interior side of the neck, outer irregularities or tolerance defects do not affect the sealing properties. Moreover, the provision of a resealable membrane allows a cap manufacturer to design the cap freely, as the functionality and construction of the cap may not be crucial for the resealability of the the spout. Hence, different designs of shape, structure etc may be applicable as long as the cap is able to guide the membrane to its sealing position.

The neck including the membrane may preferably be equipped with guiding elements for facilitating separation of a tamper ring from a cap, said guiding elements being described in the co-pending application entitled "A neck, a cap, and a food package comprising such neck and cap" and filed on the same day as the present application and by the same applicant.

Although the above description has been made with reference to a food packages, it should be readily understood that the general principle of the neck and cap could be applied to all sorts of packages provided with opening devices.

Further, the invention has mainly been described with reference to a few embodiments. However, as is readily understood by a person skilled in the art, other embodiments than the ones disclosed above are equally possible within the scope of the invention, as defined by the appended claims.

All references to "upper", "lower", "upwards", "downwards" etc. are made with respect to a package standing upright.

The invention claimed is:

1. A membrane for sealing an open spout of a food package, comprising a central circular disc member, an outer annular disc member connected to said central circular disc member along an inner periphery of the outer annular disc member at a connection angle, the outer annular disc member possessing an outer diameter, a resilient tubular portion possessing a first open end and a second end, the tubular portion being connected to the outer annular disc member, the second end of the tubular portion possessing an outer diameter smaller than the outer diameter of said outer annular disc member, the outer annular disc member being pivotable relative to the central circular disc member to increase the outer diameter of the second end of said tubular portion by changing said connection angle, the membrane being configured to seal the open spout of the food package so that a food product enclosed within the food package is sealed from an outer environment, and the first open end being free and spaced from the outer annular disc member, the first open end possessing an outer diameter, and the tubular portion possessing a tapered wall profile such that the outer diameter of the first open end is larger than the outer diameter of the second end.

2. The membrane according to claim 1, wherein the tubular portion and the outer annular disc member are formed integrally with said central circular disc member.

3. The membrane according to claim 1, wherein a connecting interface between the central circular disc member and the outer annular disc member, formed at the periphery of the central circular disc member, has a thickness which is less than the thicknesses of the central circular disc member and the outer annular disc member for allowing the outer annular disc member and the connected tubular portion to pivot relative the central circular disc member.

4. The membrane according to claim 1, wherein the tubular portion has a tapered wall profile such that the open end has an outer diameter being larger than the outer diameter of the second end.

5. The membrane according to claim 1, wherein the outer annular disc member comprises a circular recess arranged exterior of where the second end of the tubular portion is connected to the outer annular disc member.

6. The membrane according to claim 1, wherein the entire membrane is formed by high density polyethylene.

7. The membrane according to claim 1, wherein the central circular disc member has a concave shape, arranged to bulge away from a cap arranged on top of the central circular disc member.

8. A neck for a food package, comprising a tubular wall extending from an open end to an open spout along a longitudinal axis, and a membrane configured to seal the open spout of the food package, the membrane comprising a central circular disc member, an outer annular disc member connected to the central circular disc member along an inner periphery of the outer annular disc member at a connection angle, the outer annular disc member possessing an outer diameter, and a resilient tubular portion possessing a first open end and a second end, the tubular portion being connected to the outer annular disc member, the second end of the tubular portion possessing an outer diameter smaller than the outer diameter of the outer annular disc member, the outer annular disc member being pivotable relative to the central circular disc member to increase the outer diameter of the second end of the tubular portion by changing the connection angle, the membrane arranged such that the central circular disc member lies in a plane perpendicular to said longitudinal axis, and the outer annular disc member of said membrane is integrally formed with said spout to seal the open spout at a seal location, the first open end of the resilient tubular portion being radially inside the seal location.

9. The neck according to claim 8, wherein the open spout comprises a tubular wall portion having an outer diameter being smaller than the outer diameter of the outer annular disc member but larger than the outer diameter of the second end of the resilient tubular portion.

10. The neck according to claim 8, wherein said membrane is connected to said neck at the seal location by a cut-off area extending along the entire periphery of said neck.

11. The neck according to claim 8, wherein said outer annular disc member extends radially outside the tubular wall of the neck such that a membrane projection is formed and arranged to direct at least one resilient cutting element of a cap radially inwards when said cap is unscrewed such that said membrane can be separated from the neck.

12. The neck according to claim 8, further comprising threads arranged on the outer periphery of said tubular wall for engagement with corresponding threads of a cap.

13. A cap arranged to interact with a neck according to claim 8 for forming a cap/neck assembly of a food package, comprising a tubular side wall section extending between an open lower end to a closed upper end, and at least one resilient cutting element provided on the interior side of said tubular side wall section and configured to cut off a membrane of said neck when said cap is unscrewed from said neck.

14. The cap according to claim 13, wherein said at least one cutting element is extending radially upwards from the interior side of the tubular side wall section.

15. The cap according to claim 13, wherein the at least one cutting element is arranged to retain a cut off membrane of said neck adjacent to the closed upper end, by being arranged to extend past a circumferential edge of the membrane.

16. A method for applying a cap according to claim 13 onto a neck, the neck comprising a tubular wall extending from an open end to an open spout along a longitudinal axis, and a membrane, the membrane comprising: a central circular disc member; an outer annular disc member possessing an outer diameter and connected to said central circular disc member along an inner periphery of the outer annular disc member at a connection angle; and a resilient tubular portion which possesses a first open end and a second end, the resilient tubular portion being connected to the outer annular disc member, an outer diameter of said second end of the tubular portion being smaller than the outer diameter of said outer annular disc member, wherein the outer annular disc member is pivotable relative the central circular disc member for increasing the outer diameter of the second end of said tubular portion by changing said connection angle, the membrane being arranged such that the central circular disc member lies in a plane perpendicular to said longitudinal axis, and the outer annular disc member of the membrane is connected to said spout for sealing the open spout, and the outer annular disc member of said membrane is connected to said spout for sealing the open spout; the method comprising applying said cap onto said neck such that at least one resilient cutting element is pulled over said membrane.

17. A food package comprising a neck according to claim 8 and a cap arranged to interact with the neck to form a cap/neck assembly of a food package, the cap comprising a tubular side wall section extending between an open lower end to a closed upper end, and at least one resilient cutting element provided on the interior side of said tubular side wall section and configured to cut off a membrane of said neck when said cap is unscrewed from said neck.

18. The food package according to claim 17, further comprising a body section made of carton-based laminate, and a top section made of plastics, said top section comprising said neck.

19. The neck according to claim 8, wherein the spout and the membrane are molded together at the same time as a unitary structure.

20. The neck for the food package according to claim 8, wherein the membrane is configured to separate from the tubular wall at the seal location when the food package is opened, the membrane is configured to be pressed into contact with the open end of the tubular wall when the food package is closed, and the outer annular disc member contacts the tubular wall at a first contact point when the food package is closed, and the first open end of the resilient tubular portion contacts the tubular wall at a second contact point when the food package is closed, the first contact point being spaced apart from the second contact point.

* * * * *